US005283748A

United States Patent [19]

Muramatsu

[11] Patent Number: 5,283,748

[45] Date of Patent: Feb. 1, 1994

[54] EMBROIDERY DATA PRODUCING METHOD AND APPARATUS

[75] Inventor: Kiyoji Muramatsu, Nagoya, Japan

[73] Assignee: Brother Kogyo Kabushiki Kaisha, Japan

[21] Appl. No.: 823,110

[22] Filed: Jan. 21, 1992

[30] Foreign Application Priority Data

Jan. 23, 1991 [JP] Japan ..... 3-006333

[51] Int. Cl.[5] ..... G06F 15/46; D05B 21/00

[52] U.S. Cl. ..... 364/470; 112/121.12; 112/266.1; 112/457; 364/192

[58] Field of Search ..... 364/470, 188, 189, 191-193; 112/266.1, 121.11, 121.12, 121.13, 456-458

[56] References Cited

U.S. PATENT DOCUMENTS

| | | | |
|---|---|---|---|
| 4,352,334 | 10/1982 | Childs et al. | 112/266.1 |
| 4,388,883 | 6/1983 | Hirota et al. | 112/121.12 |
| 4,444,135 | 4/1984 | Yanagi et al. | 112/121.12 |
| 4,520,745 | 6/1985 | Shinomiya | 112/266.1 |
| 4,674,420 | 6/1987 | Mizuno et al. | 364/470 X |
| 4,742,786 | 5/1988 | Hashimoto et al. | 112/121.12 |
| 4,849,902 | 7/1989 | Yokoe et al. | 364/470 |
| 4,943,906 | 7/1990 | Tajima et al. | 364/470 X |
| 4,991,524 | 2/1991 | Ozaki | 364/470 |

FOREIGN PATENT DOCUMENTS 63-125284 5/1988 Japan .

*Primary Examiner*—Joseph Ruggiero

*Attorney, Agent, or Firm*—Oliff & Berridge

[57] ABSTRACT

An apparatus for producing embroidery data which are used by a sewing machine to move a sewing needle and a work cloth relative to each other so as to form stitches filling a desired original pattern on the cloth, the embroidery data including sets of coordinate data each representing a stitch position where the needle penetrates the cloth, the apparatus including a first device specifying a plurality of first defining points defining a first curve including at least one first adjustable curve segment in series, and a plurality of second defining points defining a second curve including at least one second adjustable curve segment in series and cooperating with the first curve to approximate an outline of the original pattern; a second device establishing an embroidery area by connecting between each of both ends of the first curve and a corresponding one of both ends of the second curve, and producing first sets of coordinate data representing a plurality of first stitch positions including at least one position along the first curve, and second sets of coordinate data representing a plurality of second stitch positions including at least one position along the second curve; and a third device producing the embroidery data by using the first and second sets of coordinate data, so that the sewing machine forms embroidery stitches by alternately connecting with a sewing thread between the first stitch positions and the second stitch positions according to the embroidery data.

20 Claims, 17 Drawing Sheets

FIG. 12A
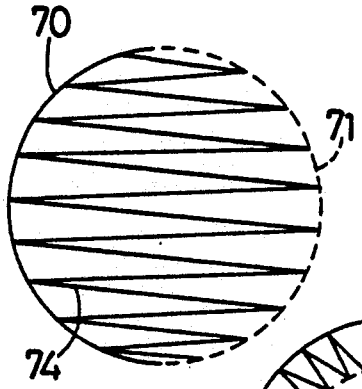
FIG. 12B
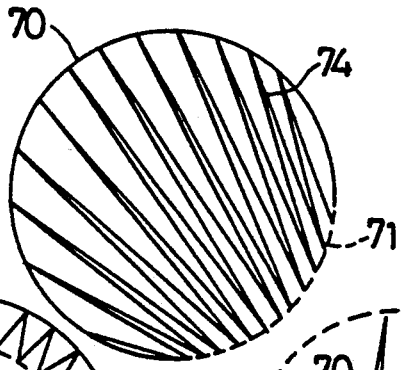
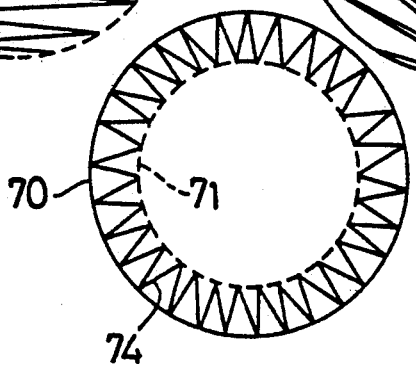
FIG. 12C
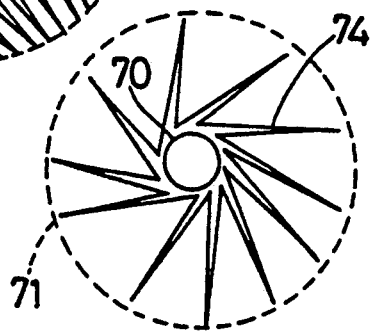
FIG. 12D

EMBROIDERY DATA PRODUCING METHOD AND APPARATUS

BACKGROUND OF THE INVENTION

1. Field of the Invention

The present invention relates to a method and apparatus for producing embroidery data used by a sewing machine.

2. Related Art Statement

It has conventionally been practiced to produce a batch of embroidery data for forming stitches filling an embroidery area, such that the embroidery data consist of a multiplicity of sets of stitch data, each set of stitch data being coordinate data representative of a stitch position where a sewing needle penetrates a work cloth. Therefore, the production of embroidery data needs operator's enormous labor to specify or input the coordinates of all the stitch positions, and in addition the embroidery data thus produced is bulky for memory means. In this background, it has been proposed to approximate an original pattern by a polygon, divide or reduce the polygon to simple polygonal blocks such as rectangles and triangles, and utilize, as embroidery data, sets of coordinate data indicative of the vertices of the polygonal blocks thus obtained. In the case where an original embroidery area at least partially outlined by a curve is embroidered, it has been practiced to approximate the curved outline or partial area by an "arcuate" block as shown in FIG. 19.

However, the conventionally used polygonal or arcuate blocks cannot sufficiently represent or approximate a curved portion of an original pattern. In order to increase the degree of representation or approximation of polygonal or arcuate blocks, it is required to divide the curved portion into more increased number of smaller blocks. This means that an increased amount of coordinate data is required for producing an embroidery with excellent external appearance. Thus, the problem that embroidery data is bulky has not been solved yet.

SUMMARY OF THE INVENTION

It is therefore an object of the present invention to provide a process and apparatus for producing a batch of embroidery data which is small in data amount and which precisely represents the outline of an original pattern even including a curved portion.

The above object has been achieved by the present invention. According to a first aspect of the present invention, there is provided a process of producing embroidery data which are used by a sewing machine to move a sewing needle and a work cloth relative to each other so as to form stitches filling a desired original pattern on the cloth, the embroidery data including sets of coordinate data each representing a stitch position where the needle penetrates the cloth, the process comprising the steps of (a) specifying a plurality of first defining points defining a first curve including at least one first adjustable curve segment in series, and a plurality of second defining points defining a second curve including at least one second adjustable curve segment in series and cooperating with the first curve to approximate an outline of the original pattern, (b) establishing an embroidery area by connecting between each of both ends of the first curve and a corresponding one of both ends of the second curve, and producing first sets of coordinate data representing a plurality of first stitch positions including at least one position along the first curve, and second sets of coordinate data representing a plurality of second stitch positions including at least one position along the second curve, and (c) producing the embroidery data by using the first and second sets of coordinate data, so that the sewing machine forms stitches filling the embroidery area by alternately connecting with a sewing thread between the first stitch positions and the second stitch positions according to the embroidery data.

In the embroidery data producing process arranged as described above, the outline of an original pattern used as a basis for producing embroidery data, is first approximated by a first curve including a single first adjustable curve segment or a plurality of first adjustable curve segments connected at ends thereof to each other in series, and a second curve including a single second adjustable curve segment or a plurality of second adjustable curve segments connected at ends thereof to each other in series. The one or more first adjustable curve segments is or are defined by specifying a plurality of first defining points, and the one or more second adjustable curve segments is or are defined by specifying a plurality of second defining points. An embroidery area is established by associating each of both ends of the first curve with a corresponding one of both ends of the second curve, that is, pairing corresponding ones of the ends of the first curve and the ends of the second curve. The above-used term "connecting" means this "association" or "pairing" between the ends of the first curve and the ends of the second curve. Based on the first curve, first sets of coordinate data are produced which represent a plurality of first stitch positions including at least one position along the first curve, and second sets of coordinate data are produced which represent a plurality of second stitch positions including at least one position along the second curve. Depending upon the shapes and/or lengths of the first and second curves, the first and second sets of coordinate data may be produced such that at least one of the first and second stitch positions is a position spaced apart from the first and second curves, for example, located at a middle point between the first and second curves. Generally, the number of stitch positions for the first curve is equal to the number of stitch positions for the second curve. A sewing machine forms stitches filling the embroidery area, by alternately connecting with a sewing thread between the first stitch positions and the second stitch positions. According to the principle of the present invention, it is possible to produce a small batch of embroidery data precisely representing the outline of any original pattern. In addition, the structure of the embroidery data produced according to the invention allows the direction of embroidery stitches to easily be changed, for example by changing the positions of embroidery start and end points on one of first and second curves relative to start and end points on the other curve with respect to an annular embroidery area defined by a large circle (i.e., first curve) and a small circle (second curve) located within the large circle. Thus, the present embroidery data producing process ensures formation of an excellent embroidery with a desired external appearance.

In a preferred embodiment according to the first aspect of the invention, the step of specifying the first and second defining points comprises specifying the first defining points defining each of at least one the first curve and the second defining points defining each of at least one the second curve, such that the each first curve is paired with a corresponding one of the at least one second curve before the first and second defining points for another pair of the first and second curves are specified.

In another embodiment according to the first aspect of the invention, the step of specifying the first and second defining points comprises specifying the first and second defining points defining a plurality of curves approximating an outline of at least one the original pattern, and subsequently grouping the curves into at least one pair of the first and second curves to approximate the outline of the at least one original pattern.

In yet another embodiment according to the first aspect of the invention, the step of specifying the first and second defining points comprises specifying the first defining points defining each of at least one the first curve and the second defining points defining each of at least one the second curve, in response to operation of input means by an operator, such that the each first curve is paired with a corresponding one of the at least one second curve to approximate the outline of a corresponding one of at least one the original pattern, the step of producing the first and second sets of coordinate data comprising automatically establishing the embroidery area for each of the at least one original pattern and producing the first and second sets of coordinate data for forming stitches filling the embroidery area for the each original pattern, after the at least one first curve is paired with a corresponding one of the at least one second curve, each in response to operation of the input means by the operator.

According to a second aspect of the present invention, there is provided an apparatus for producing embroidery data which are used by a sewing machine to move a sewing needle and a work cloth relative to each other so as to form stitches filling a desired original pattern on the cloth, the embroidery data including sets of coordinate data each representing a stitch position where the needle penetrates the cloth, the apparatus comprising (A) first means for specifying a plurality of first defining points defining a first curve including at least one first adjustable curve segment in series, and a plurality of second defining points defining a second curve including at least one second adjustable curve segment in series and cooperating with the first curve to approximate an outline of the original pattern, (B) second means for establishing an embroidery area by connecting between each of both ends of the first curve and a corresponding one of both ends of the second curve, and producing first sets of coordinate data representing a plurality of first stitch positions including at least one position along the first curve, and second sets of coordinate data representing a plurality of second stitch positions including at least one position along the second curve, and (C) third means for producing the embroidery data by using the first and second sets of coordinate data, so that the sewing machine forms stitches filling the embroidery area by alternately connecting with a sewing thread between the first stitch positions and the second stitch positions according to the embroidery data.

In an advantageous embodiment according to the second aspect of the invention, the second means produces the first and second sets of coordinate data such that at least one of the first and second stitch positions includes at least one position spaced apart from the first and second curves.

In another embodiment according to the second aspect of the invention, the apparatus further comprising memory means for storing a first set of curve data representing the first curve, and a second set of curve data representing the second curve, and means for inserting separation data between the first sets of curve data and the second sets of curve data when the memory means stores the first and second sets of curve data in sequence, the separation data indicating that the first sets of curve data are different from the second sets of curve data. In this embodiment, the second means may establish a plurality of the embroidery areas, the memory means storing sets of area data each representing a corresponding one of the embroidery areas, the each set of area data including the first set of curve data, the separation data, and the second set of curve data, the apparatus further comprising means for adding identification data to the each set of area data when the memory means stores the sets of area data in sequence, the identification data indicating that the each set of area data is different from the other sets of area data. In addition, the first means may comprise means for specifying a plurality of third defining points defining a third curve including at least one third adjustable curve segment in series, the third curve approximating an original curve along which the sewing needle is to be moved relative to the work cloth, the first memory means storing a third set of curve data representing the third curve without storing any the first separation data associated with the third set of curve data, the second means comprising means for producing at least one third set of coordinate data representing at least one third stitch position along the third curve.

In yet another embodiment according to the second aspect of the invention, the third means comprises first memory means for storing the first and second sets of coordinate data, and means for inserting first separation data between the first sets of coordinate data and the second sets of coordinate data when the first memory means stores the first and second sets of coordinate data in sequence, the first separation data indicating that the first sets of coordinate data are different from the second sets of coordinate data. In this embodiment, the second means may establish a plurality of the embroidery areas, the first memory means storing sets of embroidery data each for forming stitches filling a corresponding one of the embroidery areas, each the set of embroidery data including the first sets of coordinate data, the first separation data, and the second sets of coordinate data, the third means further comprising means for adding identification data to the each set of embroidery data when the first memory means stores the sets of embroidery data in sequence, the identification data indicating that the each set of embroidery data is different from the other sets of embroidery data. In addition, the apparatus may further comprise second memory means for storing a first set of curve data representing the first curve, and a second set of curve data representing the second curve, and means for inserting second separation data between the first sets of curve data and the second sets of curve data when the second memory means stores the first and second sets of curve data in sequence, the second separation data indicating that the first sets of curve data are different from the second sets of curve data, the first means comprising means for specifying a plurality of third defining points defining a third curve including at least one third adjustable curve segment in series, the third curve approximating an original curve along which the sewing needle is to be moved relative to the work cloth, the second memory means storing a third set of curve data representing the third curve without storing any the second separation data associated with the third set of curve data, the second means comprising means for producing at least one third set of coordinate data representing at least one third stitch position along the third curve, the first memory means storing the at least one third set of coordinate data without storing any the identification data associated with the at least one third set of coordinate data, the third means producing the embroidery data by using the at least one third set of coordinate data, so that the sewing machine forms at least one stitch along the third curve with the sewing thread according to the embroidery data so as to move the sewing needle relative to the work cloth.

In a further embodiment according to the second aspect of the invention, the first means comprises display means for indicating the first and second curves together with the outline of the original pattern, and adjusting means for moving at least one of the first and second defining points on the display means, and thereby adjusting at least one of the first and second adjustable curve segments so that the first and second curves precisely approximate the outline of the original pattern.

In a preferred embodiment according to the second aspect of the invention, the first means comprises changing means for changing at least one of the first defining points and at least one of the second defining points so as to adjust at least one the first adjustable curve segment and at least one the second adjustable curve segment, respectively, and thereby precisely approximate the outline of the original pattern. In this embodiment, the first means may specify the first defining points such that the first defining points include two first base points which are positioned on the outline of the original pattern and define both ends of a corresponding one of the at least one first adjustable curve segment, respectively, and two first control points different from the two first base points, the two first base points and the two first control points cooperating with each other to define a first Bezier curve as the corresponding one first adjustable curve segment, the first means specifying the second defining points such that the second defining points include two second base points which are positioned on the outline of the original pattern and define both ends of a corresponding one of the at least one second adjustable curve segment, respectively, and two second control points different from the two second base points, the two second base points and the two second control points cooperating with each other to define a second Bezier curve as the corresponding one second adjustable curve segment, the changing means of the first means changing at least one of the two first control points for adjusting the first Bezier curve and at least one of the two second control points for adjusting the second Bezier curve.

BRIEF DESCRIPTION OF THE DRAWINGS

The above and optional objects, features, and advantages of the present invention will be better understood by reading the following detailed description of the presently preferred embodiments of the invention when considered in conjunction with the accompanying drawings, in which:

FIGS. 12A through 12D are views of examples of original patterns and the embroideries formed in the patterns in accordance with the present invention;

DETAILED DESCRIPTION OF THE PREFERRED EMBODIMENTS

Figure 1:
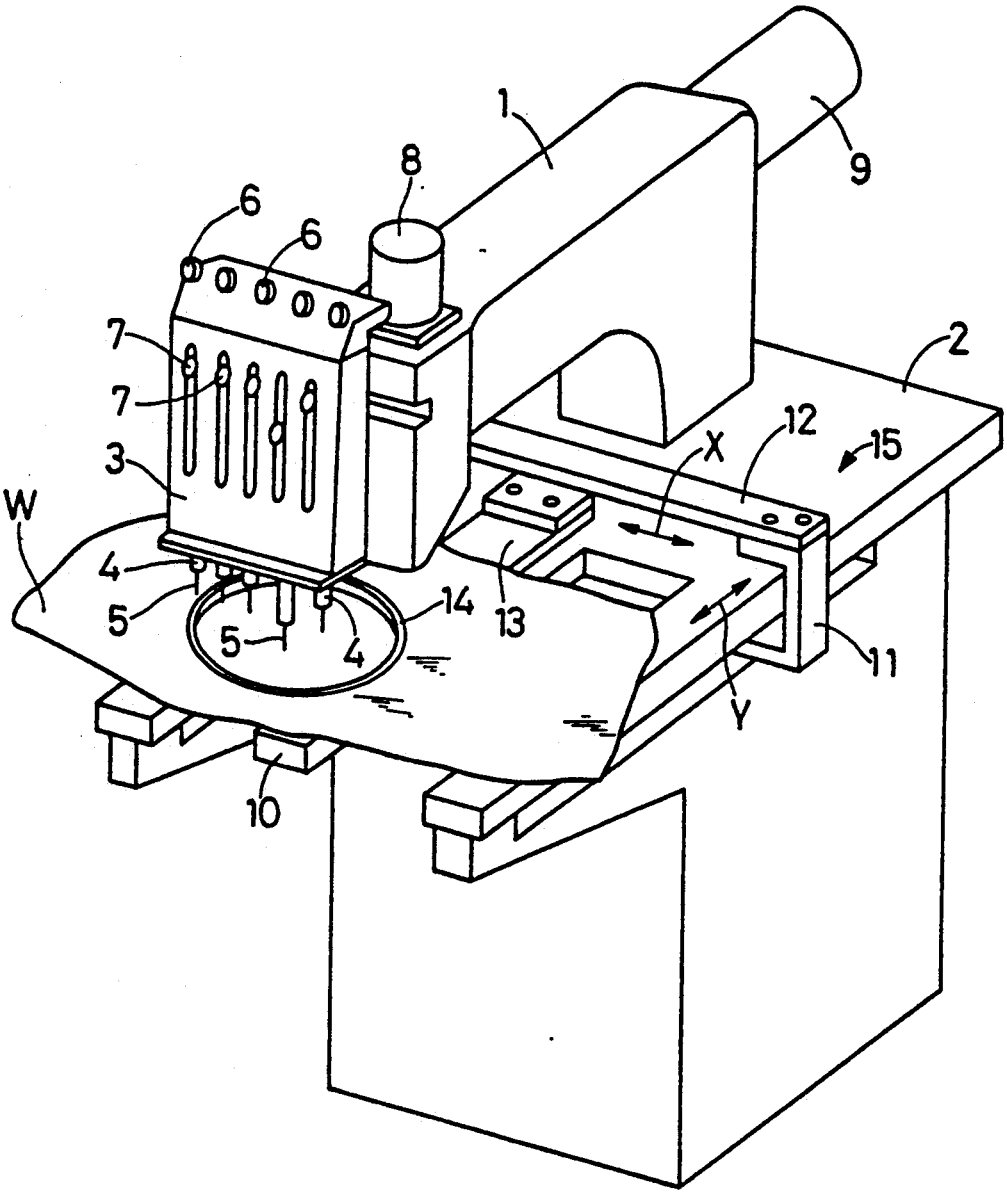
FIG. 1 is a schematic view of a multiple-needle embroidery sewing machine.

Referring first to FIG. 1, there is shown a multiple needle-type embroidery sewing machine which forms an embroidery by utilizing embroidery data produced by a data processing apparatus (FIG. 3) according to the present invention. The sewing machine includes a table 2 on which machine's main body including a horizontally extending arm 1 is disposed. A needle bar support case 3 is secured to the free end of the horizontal arm 1 such that the support case 3 is movable in an X direction indicated at arrow in the figure, that is, parallel to the surface of the table 2 and perpendicular to the horizontal arm 1. The support case 3 supports five needle bars 4. A sewing needle 5 is detachably attached to the lower end of each needle bar 4. The respective needles 5 are supplied with different sorts of sewing threads from corresponding thread supplying devices (not shown) via tension thread guide assemblies 6 and thread take-up levers 7 mounted on the support case 3. The support case 3 is operatively connected to a needle select motor 8 mounted on the horizontal arm 1, such that upon receipt of a needle select signal (FIG. 2) the motor 8 moves the support case 3 so that a selected one of the five needle bars 4 (or needles 5) is indexed at an operative position where the selected needle 5 is vertically reciprocated.

More specifically, the selected needle bar 4 is operatively connected to a main motor 9 disposed at the rear of the horizontal arm 1, via a power transmission mechanism (not shown) provided in the arm 1, so that the needle 5 is endwise oscillated by being driven by the motor 9. A bed 10 extends horizontally from the table 2 such that the free end portion of the bed 10 is opposed to the selected needle bar 4 indexed at the operative position. The free end portion of the bed 10 supports a thread loop hooking assembly (not shown) which cooperates with the needle 5 to form stitches on a work cloth W. The needle 5, thread loop hooking assembly, and others cooperate with each other to serve as means for forming stitches on the cloth W.

At the right- and left-hand ends of the table 2, there are disposed a pair of Y-direction movable holders 11 (only one is shown in FIG. 1), respectively. The Y-direction holders 11 are movable in a positive or negative direction of a Y direction perpendicular to the X direction. The holders 11 are moved by being driven by a Y-direction drive motor (not shown). A support plate 12 is fixed at opposite ends thereof to the two Y-direction holders 11, respectively. The support plate 12 supports one of opposite ends of an X-direction movable holder 13 such that the X-direction holder 13 is movable in a positive or negative direction of the X direction by being driven by an X-direction drive motor (not shown). A workholder 14 for holding the work cloth W is secured to the free end of the X-direction holder 13. Thus, the workholder 14 or work cloth W is movable to any desired position relative to the needle 5 located at the operative position, in an orthogonal X-Y coordinate system defined by the X and Y directions. The Y-direction movable holder 11, Y-direction drive motor, X-direction movable holder 13, X-direction drive motor, workholder 14, and others cooperate with each other to constitute a work cloth feed mechanism 15.

Figure 2:
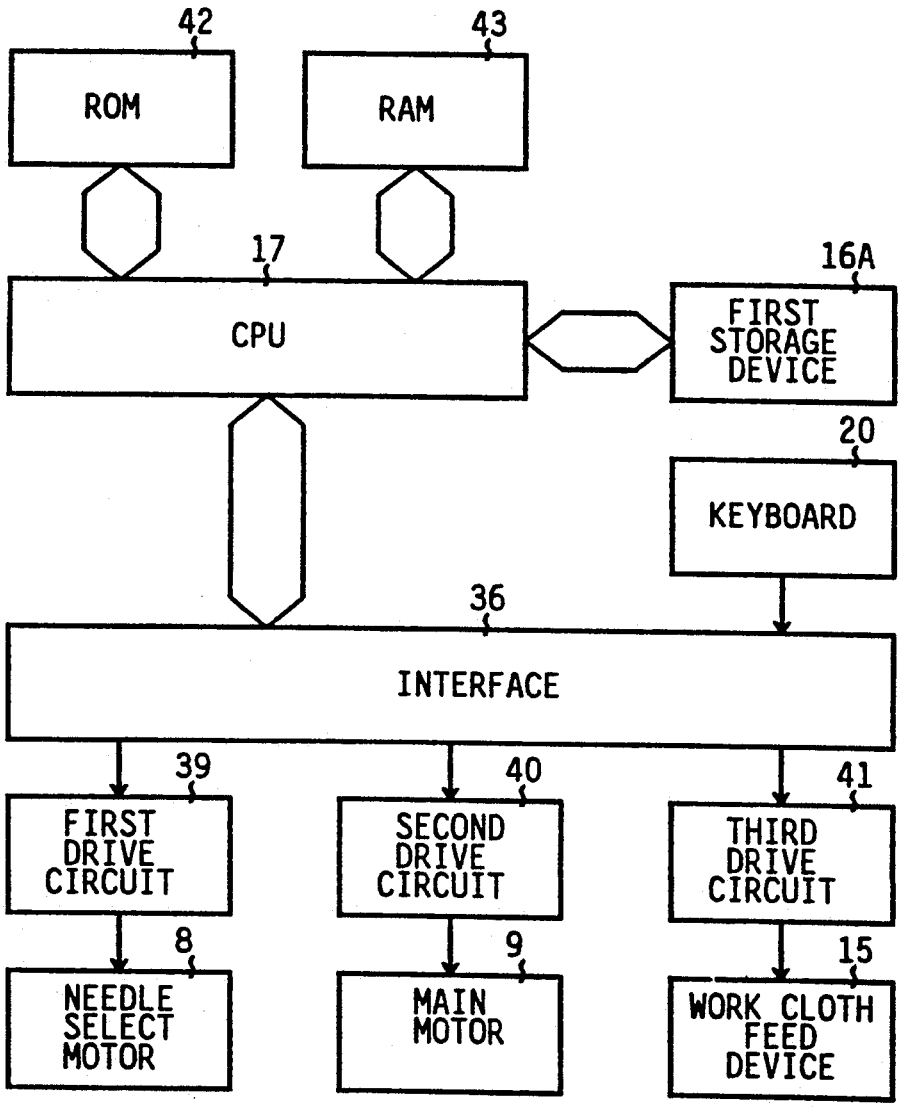
FIG. 2 is a diagrammatic view of a control circuit for the sewing machine of FIG. 1.

Referring next to FIG. 2, there is shown a control device for controlling the multiple-needle embroidery sewing machine of FIG. 1. The control device consists essentially of a microcomputer including a central processing unit (CPU) 17, a program memory (read only memory, ROM) 42, a working memory (random access memory, RAM) 43, and an interface 36. The interface 36 is connected to the needle select motor 8, main motor 9, and work cloth feed mechanism 15 via a first, second, and third drive circuit 39, 40, 41, respectively. The interface 36 is also connected to the CPU 17. The CPU 17 operates according to control programs pre-stored in the ROM 42. The CPU 17 is connected to a first external storage device 16A which stores embroidery data including sets of stitch data or coordinate data. Each set of stitch data or coordinate data is representative of a stitch position where the needle 5 at the operative position penetrates the work cloth W held by the workholder 14 to form a stitch on the cloth W. In addition, the interface 36 is connected to input means in the form of a keyboard 20 through which an operator inputs instructions to the computer. Upon input of a sewing instruction through the keyboard 20, the CPU 17 successively reads in sets of coordinate data from the first storage device 16A, and supplies appropriate numerical values to the first to third drive circuits 39, 40, 41, respectively, via the interface 36, so that the sewing machine of FIG. 1 is driven to form on the work cloth W an embroidery represented by the sets of coordinate data or embroidery data.

Figure 3:
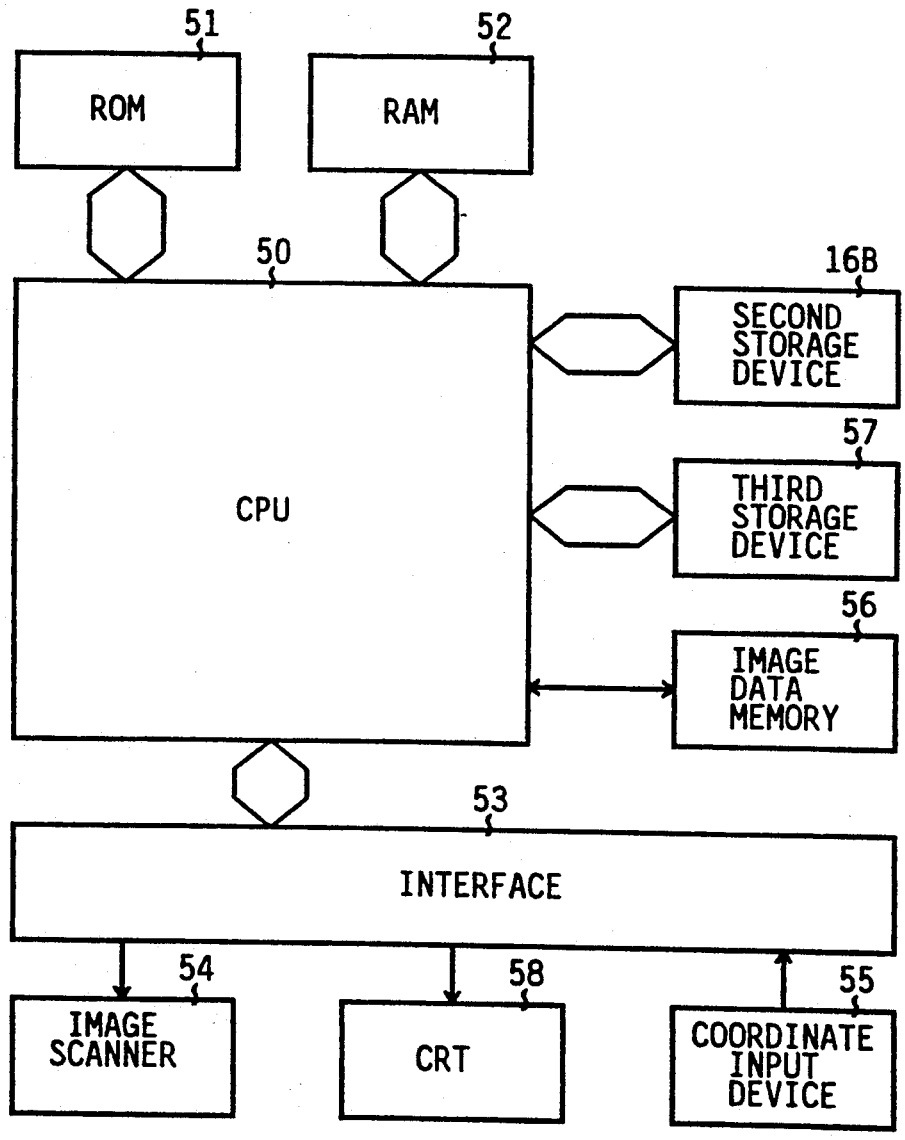
FIG. 3 is a diagrammatic view of an embroidery data processing apparatus according to the present invention.

Referring further to FIG. 3, there is shown the embroidery data processing apparatus according to the present invention. The present apparatus is functionally independent of the sewing machine of FIG. 1 and the control device therefor of FIG. 2. The processing apparatus includes a microcomputer consisting essentially of a CPU 50, a program memory (ROM) 51, a working memory (RAM) 52, and an interface 53. The ROM 51 serves for pre-storing a control program for effecting a series of steps beginning with reading an original image or pattern and ending with storing a batch of embroidery data produced. The CPU 50 is connected to an image data memory 56 for temporarily storing image data representative of an original image, that is, original embroidery pattern.

The CPU 50 is also connected to a third external storage device 57, including memory means such as a floppy disk, for storing embroidery area data produced by the present processing apparatus, and a second external storage device 16B for storing embroidery data produced by the present apparatus. The first external storage device 16A of the control device of FIG. 2 may be used as the second storage external device 16B. That is, the present processing apparatus may be used by being operatively connected to the control device for the sewing machine of FIG. 1. In this case, the embroidery data produced by the present processing apparatus is supplied via the storage device 16A (16B) to the embroidery sewing machine of FIG. 1. In addition, the CPU 50 is connected, via the interface 53, to an image scanner 54 for taking or reading an original image or original embroidery pattern (hereinafter, referred to as the "original pattern"); a coordinate input device 55, such as a keyboard, mouse, or digitizer, through which the operator inputs coordinate data; and a cathode ray tube (CRT) 58.

Figure 4:
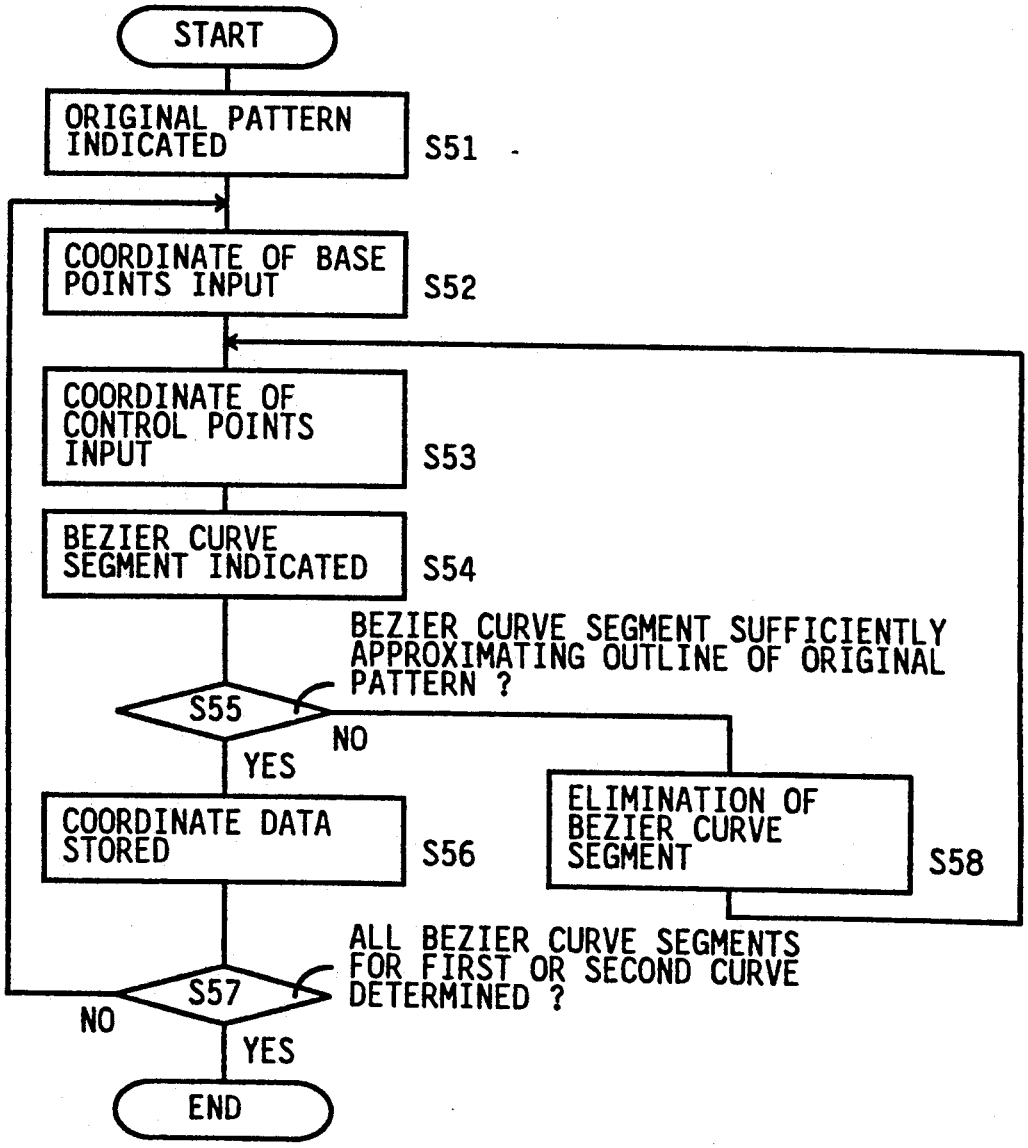
FIG. 4 shows a flow chart according to which base points and control points are specified for defining Bezier curve segments.
Figure 5:
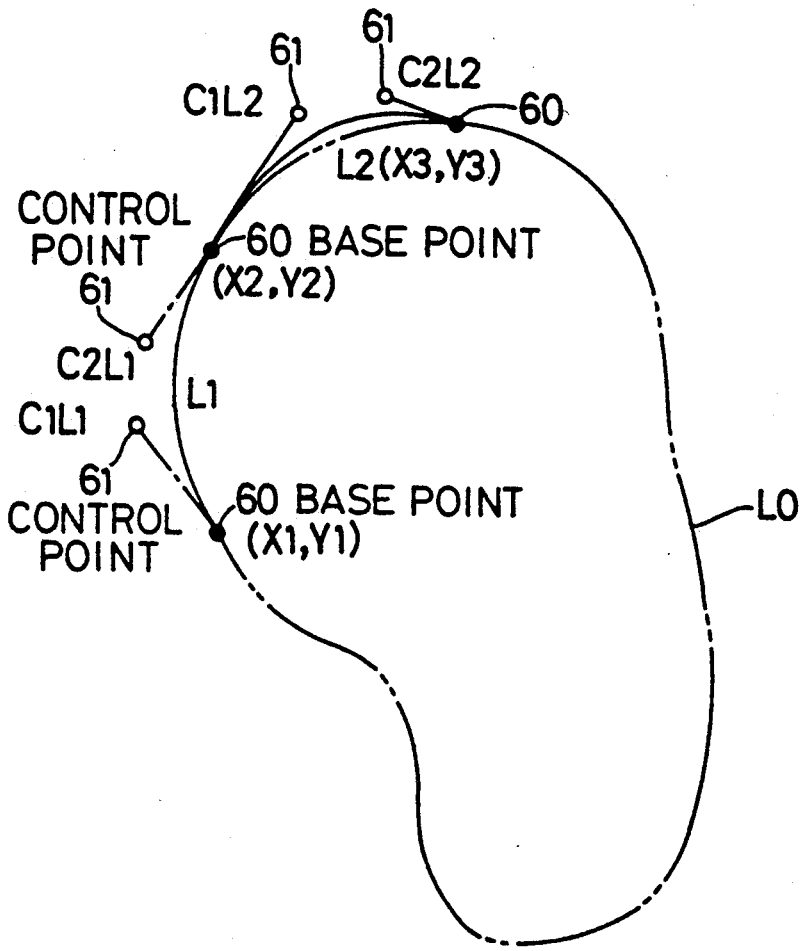
FIG. 5 is a view of the outline of an original pattern, simultaneously showing base and control points for defining Bezier curve segments providing a first and a second curve which cooperate with each other to approximate the original outline.

Hereinafter, by reference to the flow chart of FIG. 4, the operation of the embroidery data processing apparatus of FIG. 3 will be described in detail. An original pattern is read through the image scanner 54, and image data representing the original pattern is stored in the image data memory 56. In Step S51, the CPU 50 operates for displaying on the CRT 58 the original pattern based on the image data stored in the image memory 56. While viewing the original pattern indicated on the CRT 58, the operator specifies or establishes an embroidery area to be filled with embroidery stitches, by using the coordinate input device 55 such as a mouse, as follows: First, in Step S52, while viewing the original pattern on the CRT 58, the operator specifies, by using the mouse 55, two base points 60, 60 on an outline, $L_0$, of the original pattern indicated in two-dot chain line in FIG. 5. Thus, two sets of coordinate data representative of the respective X and Y coordinates, $(X_1, Y_1)$ and $(X_2, Y_2)$, of the two base points are input to the data processing apparatus. The two base points 60, 60 define both ends of an appropriate straight or curve segment, $L_1$, belonging to the original outline $L_0$, respectively.

In Step S53, the operator additionally specifies two control points 61, 61 on the CRT 58 by using the mouse 55. Consequently, two sets of coordinate data representative of the respective X and Y coordinates of an initially specified two control points are input to the processing apparatus. In Step S54, the CPU 50 determines a Bezier curve segment based on the two base points 60, 60 and the two control points 61, 61, according to a control program pre-stored in the ROM 51, and displays on the CRT 58 the determined Bezier curve segment with a color different from the color of the original outline segment $L_1$. The technique for determining a Bezier curve segment based on two base points and two control points is well known in the art, for example, by "Figure Processing Technique Using Computer-Assisted Display [2]" by Fujio Yamaguchi, Nikkan Kogyo Press Inc., Japan. Also, detailed description of Bezier curve or Bezier function is provided in U.S. Pat. Application Ser. No. 07/653,298 assigned to the Assignee of the present application. Accordingly, no more description of this technique is provided here.

In Step S55, the operator compares the Bezier curve segment with the original outline segment $L_1$, and judges whether or not the Bezier curve segment sufficiently approximates the original outline segment $L_1$. If the operator makes an affirmative judgement (YES) in Step S55 and inputs appropriate data through the mouse 55, for example, the CPU 50 stores a set of curve segment data representative of the Bezier curve segment, in the third storage device 57, in Step S56. To the contrary, if the operator makes a negative judgement (NO) in Step S55 and inputs different data into the processing apparatus, the CPU 50 eliminates the Bezier curve segment on the CRT 58, in Step S58. In this situation, however, the two control points 61, 61 do not disappear from the CRT screen 58. In this case, back to Step S53, the operator specifies new two control points 61, 61 on the CRT 58 by using the mouse 55, more specifically, changes one or both of the two old control points, to one or two new control points. Thus, two base points 60, 60 and two control points 61, 61 cooperate with each other to serve as four defining points which cooperate with each other to define a Bezier curve segment as an adjustable curve segment.

In the case where a negative judgement is made in Step S57 after a Bezier curve segment has been determined and stored with respect to the initial or first original outline segment $L_1$ in Step S56, another Bezier curve segment is determined through Steps S53 to S57 with respect to the following, second original outline segment, $L_2$, which is connected in series to the first original outline segment $L_1$, that is, connected at one end thereof to one end of the first outline segment $L_1$. The first and second original outline segments $L_1$, $L_2$ share the common base point 60 $(X_2, Y_2)$. Therefore, a Bezier curve segment can be defined for the second original outline segment $L_2$, by specifying the other base point 60, $(X_3, Y_3)$, on the original outline $L_0$, together with two control points 61, 61.

Figure 6:
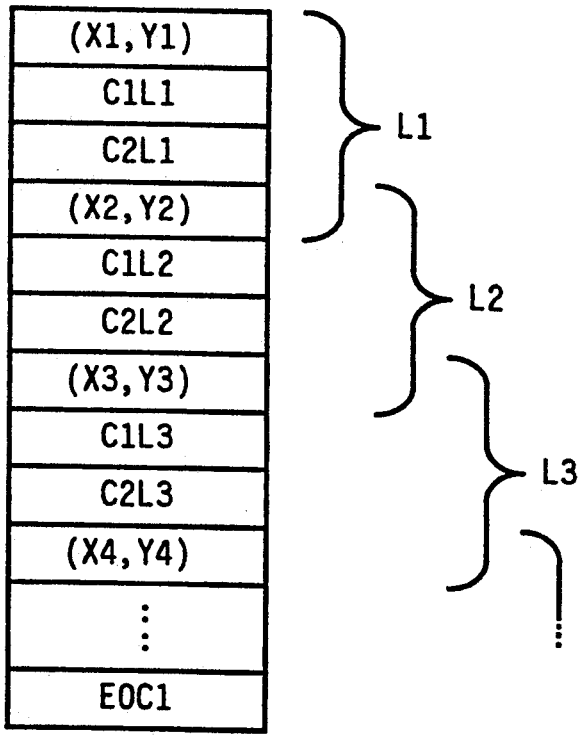
FIG. 6 is an illustrative view for explaining the structure of a set of first or second curve data representing a first or second curve for approximating the outline of an original pattern.

Thus, a first Bezier curve segment approximating the first original outline segment $L_1$ is determined by specifying the two base points $(X_1, Y_1)$, $(X_2, Y_2)$ and the two control points $C_1L_1$, $C_2L_1$, while a second Bezier curve segment approximating the second original outline segment $L_1$ is determined by specifying the two base points $(X_2, Y_2)$, $(X_3, Y_3)$ and the two control points $C_1L_2$, $C_2L2$. The first and second Bezier curve segments are connected to each other in series as described above. In the same way, a third, a fourth, . . . Bezier curve segment are determined for the third, fourth, . . . original outline segments belonging to the original outline $L_0$, such that the first, second, third, . . . Bezier curve segments are connected to each other in series and cooperate with each other to constitute a first curve 70 (indicated in solid line in FIG. 7) approximating the original outline $L_0$. Similarly, a second curve 71 (indicated in broken line in FIG. 7) is defined by Bezier curve segments connected to each other in series. The second curve 71 cooperates with the first curve 70 to approximate the original outline $L_0$. The CPU 50 successively stores sets of coordinate data for the base and control points for each of the Bezier curve segments for the first and second curves 70, 71, in the third storage device 57, in a manner shown in FIG. 6. The CPU 50 adds a separation code, $EOC_1$, to the end of a set of first or second curve data representative of the first or second curve 70, 71 for the original outline $L_0$.

Figure 7:
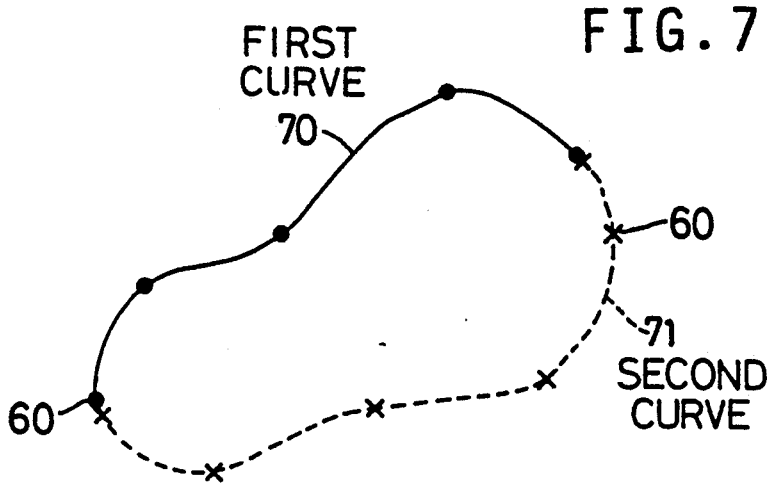
FIG. 7 is a view of an embroidery area defined by a first and a second curve.
Figure 8:
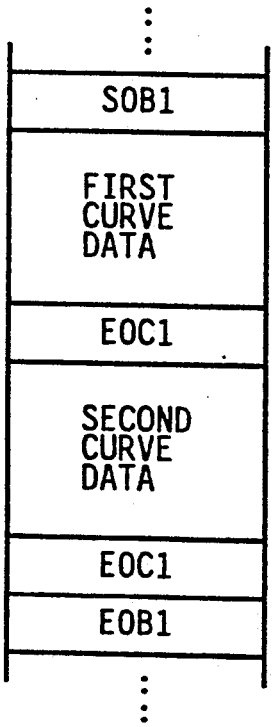
FIG. 8 is an illustrative view for explaining the structure of a set of area data representing an embroidery area defined by a first and a second curve.

As shown in FIG. 7, the first and second curves 70, 71 cooperate with each other to approximate the outline $L_0$ of the original pattern taken through the image scanner 54. An embroidery area to be filled with embroidery stitches is established by pairing each of both ends of the first curve 70 and a corresponding one of both ends of the second curve 71. The correspondence between the two ends of the first curve 70 and the two ends of the second curve 71 is automatically determined based on the order of input of the defining points 60, 61 (base and control points) for the Bezier curve segments belonging to the first or second curve 70, 71. FIG. 8 shows a set of embroidery area data representative of the first and second curves 70, 71, stored in the third storage device 57. In the third storage device 57, the CPU 50 first stores a start code, $SOB_1$, subsequently, a set of first curve data for the first curve 70, then a set of second curve data for the second curve 71, and last adds an end code, $EOB_1$.

In the event that one or more original patterns different from the original pattern $L_0$ is or are to be embroidered together, one or more sets of embroidery area data is or are produced and stored in the third storage device 57. In this event, too, start and end codes SOB1, EOB1 are added to the head and end (or tail) of each set of embroidery area data. However, the CPU 50 does not add a start or an end code SOB1, EOB1 to a set of curve data which does not represent an embroidery area; such as curve data representing an original curve or "running path" along which the sewing needle 5 is to be moved relative to the work cloth W. The curve data for the running path are also stored in the third storage device 57.

Thus, a set of embroidery area data representing a pair of first and second curves 70, 71, is stored in the third storage device 57. Although the foregoing steps include steps requiring operator's assistance, the following steps are automatically effected in the present embodiment.

Figure 10:
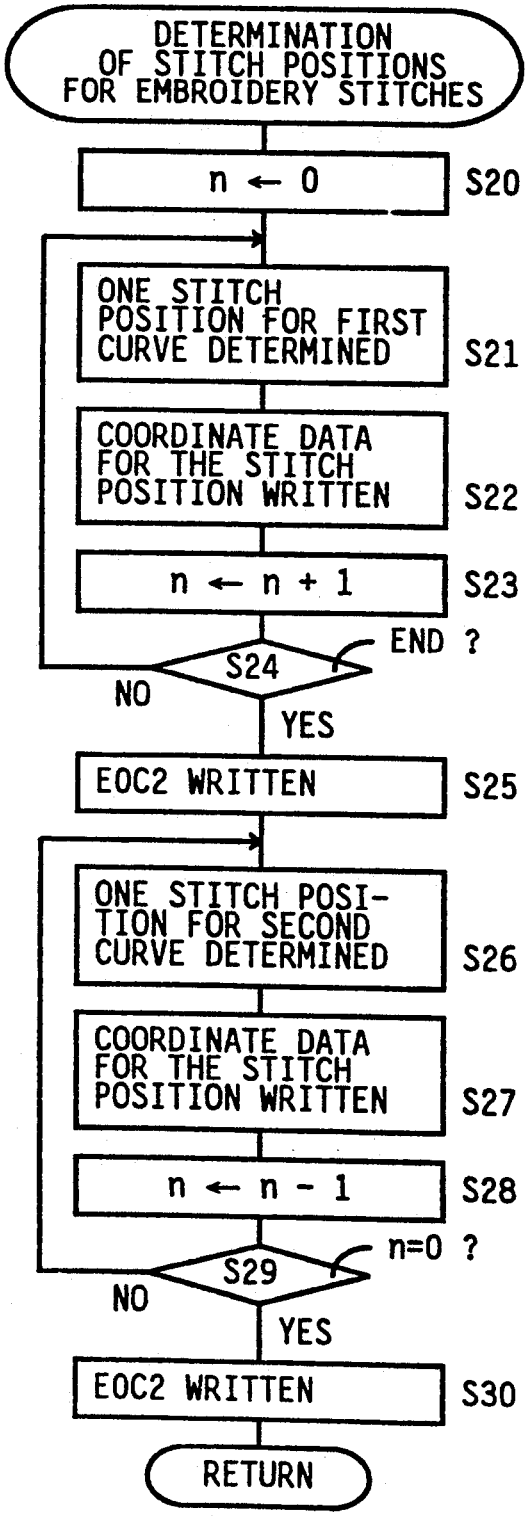
FIG. 10 shows a flow chart according to which stitch positions for embroidery stitches are determined.
Figure 11:
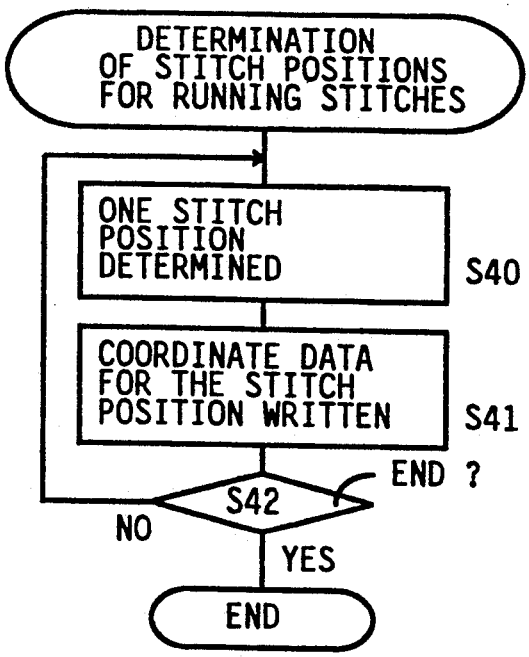
FIG. 11 shows a flow chart according to which stitch positions for running stitches are determined.

By reference to the flow charts of FIGS. 9, 10, and 11, there will be described the operation of the present apparatus for producing a batch of embroidery data based on a set of embroidery area data stored in the third storage device 57, and storing the embroidery data in the second storage device 16B.

Figure 9:
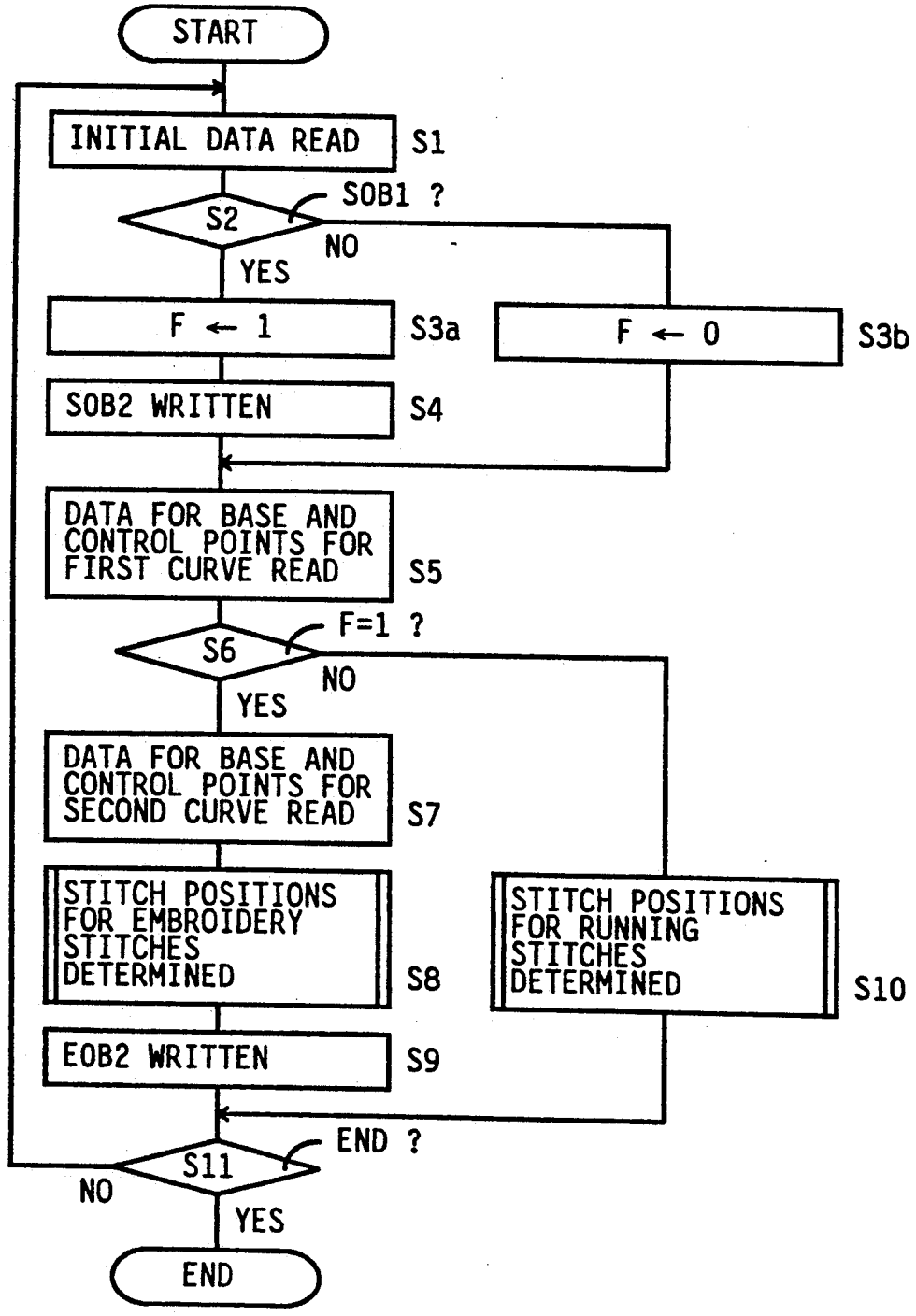
FIG. 9 shows a flow chart according to which embroidery data is produced based on a set of area data.

First, in Step S1 of FIG. 9, the CPU 50 accesses the initial address in the third storage device 57, and in Step S2 the CPU 50 identifies whether or not the data stored at the initial address is start code $SOB_1$. If an affirmative judgement is made in Step S2, the control of the CPU 50 proceeds with Step S3*a* to set a flag, F, to F=1 and further to Step S4 to store in the second storage device 16B a start code, $SOB_2$, indicating that the data following code $SOB_2$ is a batch of embroidery data used for forming stitches filling an embroidery area. To the contrary, if a negative judgement is provided in Step S2, the control goes to Step S3*b* to set flag F to F=0. Step S4 or Step S3*b* is followed by Step S5 to successively read in the sets of coordinate data for the defining points 60, 61 for the first curve 70 from the third storage device 57 and store them in the second storage device 16B until separation code $EOC_1$ is read in from the third storage device 57.

Step S5 is followed by Step S6 to identify whether or not flag F is in the state of F=1. If an affirmative judgement is made, the control goes to Step S7 to successively read in the sets of coordinate data for the defining points 60, 61 for the second curve 70 and store them in the second storage device 16B until separation code EOC1 is accessed. Subsequently, in Step S8, the CPU 50 produces a batch of embroidery data according to the flow chart of FIG. 10, and in Step S9 the CPU 50 stores in the second storage device 16B an end code, EOB2, indicating that the data preceding the code EOB2 is a set of embroidery data. Meanwhile, if a negative judgement is made in Step S6, that means that the data read and stored in Step S5 is curve data from which one or more sets of coordinate data for running stitches is or are to be produced. In this case, the CPU 50 produces a batch of coordinate data or stitch data according to the flow chart of FIG. 11. Step S9 or Step S10 is followed by Step S11 to identify whether no data is left in the third storage device 57 and therefore the operation should be terminated. If an affirmative judgement is made in Step S11, the CPU 50 terminates the operation. On the other hand, if a negative judgement is made in Step S11, that is, if any data is left, the control of the CPU 50 goes back to Step S1.

By reference to the flow chart of FIG. 10, there will be described in detail the production of a batch of embroidery data in Step S8 of FIG. 9. First, in Step S20, a counter whose content or count is indicative of a number, n, of stitch positions is reset to zero. Step S20 is followed by Step S21 to determine the curvature (i.e., radius) of a small portion of the initial or first Bezier curve segment on the first curve 70 and the curvature (radius) of a corresponding small portion of the first Bezier curve segment on the second curve 71. The technique of determining the curvature or radius of a small curve segment is described in detail in U.S. Pat. No. 4,444,135. A stitch pitch at which each pair of adjacent two stitch positions are spaced from each other on the first or second curve 70, 71 is pre-set in the present apparatus, for a longer one of the first and second curves 70, 71, and data indicative of the stitch pitch is stored in the RAM 52. If the two curvatures of the corresponding two small curved portions on the first and second curves 70, 71, and the pre-set stitch pitch meet pre-determined relationships, the CPU 50 locates a stitch position for the first curve 70 at a position apart from the first curve 70 (e.g., at a middle point between the two curves), so as to make uniform the density of embroidery stitches formed between the above-indicated corresponding two small curved portions on the first and second curves 70, 71. On the other hand, if not so, the CPU 50 locates a stitch position for the first curve 70 at a position along or on the first curve 70. Examples of the above-indicated relationships are described in detail in U.S. Pat. No. 4,520,745. Step S21 is followed by Step S22 to prepare and store a set of coordinate data representative of the thus determined stitch position for the first curve 70, in the second storage device 16B. Step S22 is followed by Step S23 to increment the content n of the counter by one. In the following Step S24, it is judged whether or not all stitch positions for the first curve 70 have been determined. If the CPU 50 has treated the remaining or other end of the first curve 70 in Step S21, an affirmative judgement is made in Step S24. In this case, the control of the CPU 50 goes to Step S25 to store in the second storage device 16B a separation code, $SOC_2$, indicating that the data preceding code $SOC_2$ are a batch of stitch data each representing a stitch position where the needle 5 is to penetrate the work cloth W. On the other hand, if a negative judgement is made in Step S24, the control goes back to Step S21.

Step S25 is followed by Step S26 to carry out the same operation as that carried out in Step S21, with respect to the Bezier curve segments on the second curve 71, so as to determine stitch positions for the second curve 71. In this step, too, one or more stitch positions may be located at a position or positions apart from the second curve 71. Step S26 is followed by Step S27 to prepare and store sets of coordinate data representative of the stitch positions, in the second storage device 16B. In the following Step S28, the content n of the counter is decremented by one. Step 28 is followed by Step S29 to judge whether or not the count n is zero. If a negative judgement is made in Step S29, the control of the CPU 50 goes back to Step S26. On the other hand, if an affirmative judgement is made in Step S29, the control goes to Step S30 to store a separation code $EOC_2$ in the second storage device 16B. An affirmative judgement in Step S29 means that all stitch positions have been determined for the second curve 71. Thus, Step S8 of the flow chart of FIG. 9 is terminated.

By reference to the flow chart of FIG. 11, there will be described in detail the production of a batch of stitch data for running stitches in Step S10 of FIG. 9. Initially, in Step S40, the CPU 50 locates a stitch position on a first curve including one or more Bezier curve segments in series. The first curve is represented by a set of curve data stored without codes $SOB_1$, $EOB_1$, in the third storage device 57, and approximates the running path (original curve) along which the needle 5 is to be moved relative to the work cloth W. The Bezier curve segment or segments for the first curve is or are defined by base points and control points in the same manner as that for the first and second curves 70, 71 approximating the original outline $L_0$. The stitch position is so determined that a running stitch formed between adjacent two stitch positions has a predetermined length much longer than the stitch pitch for the embroidery stitches formed in the embroidery area. Step S40 is followed by Step S41 to prepare and store in the second storage device 16B a set of coordinate data representative of the determined stitch position. In the following Step S42, it is judged whether or not all stitch positions have been determined for the first curve approximating the running path. If the CPU 50 has reached the remaining or other end of the first curve, an affirmative judgement is made in Step S42. In this case, the control of the CPU 50 goes to Step S43 to store a separation code $EOC_2$ in the second storage device 16B. On the other hand, if a negative judgement is made in Step S42, the control of the CPU 50 goes back to Step S40. The affirmative judgement in Step S42 means that all stitch positions have been determined for the running path. Thus, Step S10 of the flow chart of FIG. 9 is ended.

Subsequently, another pair of first and second curves are specified, and another batch of embroidery data is produced for an embroidery area defined by the specified first and second curves. Thus, batches of embroidery data are produced for all original patterns taken by the image scanner 54.

Consequently, the second storage device 16B stores the batches of embroidery data, each batch of embroidery data including sets of coordinate data or stitch data. Subsequently, memory means, such as a floppy disk, storing the batches of embroidery data is taken out of the second storage device 16B, and is set in the first storage device 16A (FIG. 2) of the multiple-needle embroidery sewing machine of FIG. 1. The sewing machine forms stitches filling an embroidery area by alternately connecting with a sewing thread between stitch positions represented by first sets of stitch data prior to separation code $EOC_2$ in a batch of embroidery data sandwiched by a pair of identification codes $SOB_2$, $EOB_2$ and stitch positions represented by second sets of stitch data subsequent to the separation code $EOC_2$ in the same batch of embroidery data. A batch of stitch data which are not sandwiched by a pair of identification codes $SOB_2$, $EOB_2$ are data for forming running stitches along the first curve approximating the original curve or running path. The sewing machine forms running stitches at stitch positions represented by the batch of stitch data not sandwiched by codes $SOB_2$, $EOB_2$. Running stitches formed along a running path are well known in the art and therefore no further description thereof is provided.

Figure 13A:
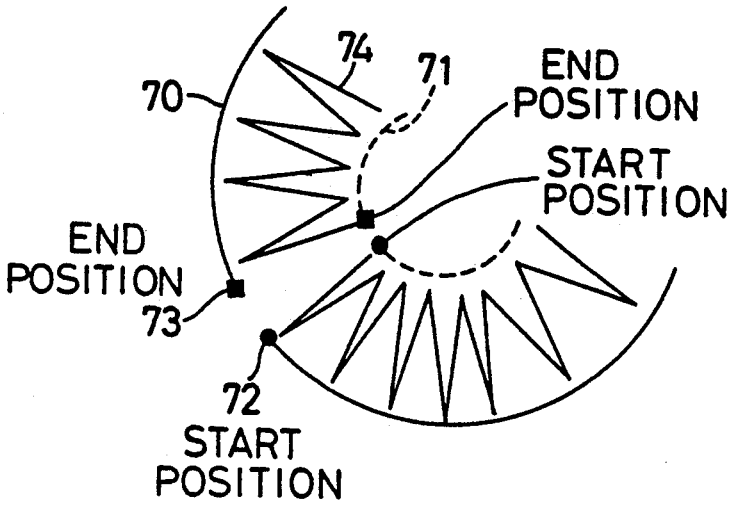
FIGS. 13A and 13B are views of examples of embroideries which are changeable by moving start and/or end positions on one of first and second curves relative to those on the other curve.
Figure 13B:
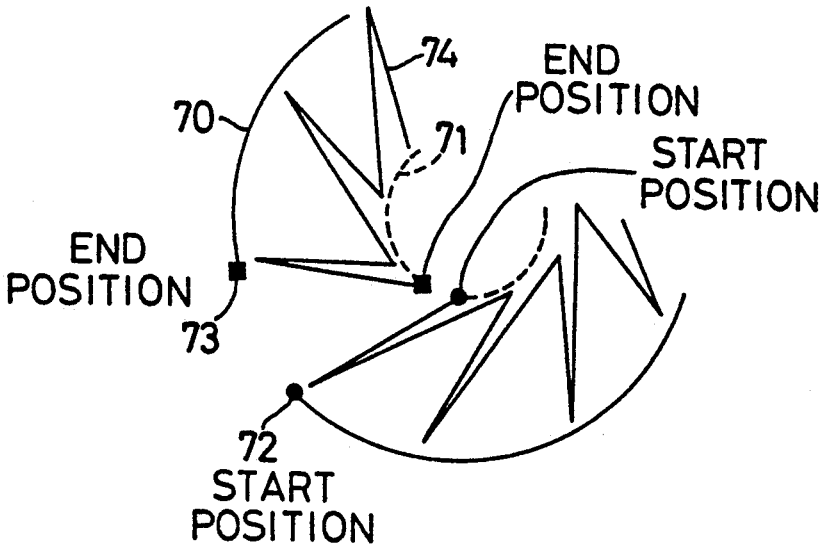

Referring next to FIGS. 12A through 12D, there are shown examples of original patterns 70, 71, and embroidery stitches 74 formed according to embroidery data produced by the present data processing apparatus (stitches 74 are illustrated in a coarse fashion for easier understanding thereof). FIG. 12A shows stitches 74 filling a circular embroidery area with a uniform density of stitches. In this case, first and second curves 70, 71 are opposed to each other while providing circular arcs having generally equal lengths. FIG. 12B shows a circular embroidery area similar to that of FIG. 12A but is defined by a first curve 70 and a second half curve 71 whose length is much smaller than that of the first curve 70. In this case, stitches are formed in the circular area such that the stitches spread generally radially from the second curve 71. FIG. 12C shows embroidery stitches 74 formed in an annular area defined by a first curve 70 (i.e., larger circle) and a second curve 71 (i.e., smaller circle located within the larger circle 70). It has conventionally been impossible to approximate an annular area by a single polygonal or arcuate block. An irregular embroidery of FIG. 12D which had not been produced by using a polygonal or arcuate block, is easily produced by changing start and end positions 72, 73 on a first curve 70 of an original pattern (FIG. 13A) relative to start and end positions on a second curve 71, to different start and end positions 72, 73 as indicated in FIG. 13B, respectively.

Figure 14:
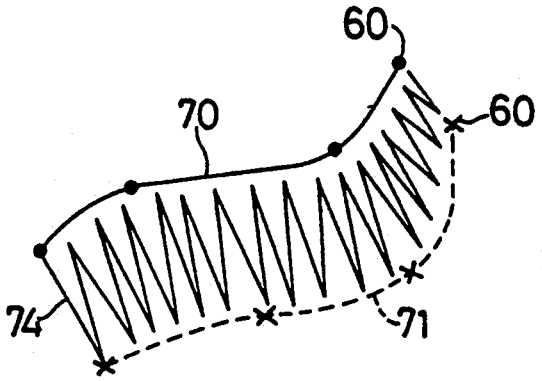
FIG. 14 a view of an example of an original pattern defined by a first curve and a second curve whose ends are apart from corresponding ends of the first curve, and an embroidery formed in the pattern in accordance with the present invention.

As can be understood from the foregoing description, the present embroidery data processing apparatus produces a batch of embroidery data for an embroidery area, as shown in FIG. 14, which is defined by a first curve and a second curve whose ends are apart from corresponding ends of the first curve. In this case, the data processing apparatus establishes an embroidery area by connecting with virtual lines between the two ends of the first curve and the corresponding ends of the second curve 71, respectively. The embroidery sewing machine of FIG. 1 forms stitches 74 filling the embroidery area by using the embroidery data produced by the data processing apparatus. It is therefore understood that the present processing apparatus is very useful for producing embroidery data for forming stitches filling embroidery blocks such as quadrangular or arcuate blocks resulting from dividing a complex embroidery area.

Figure 15:
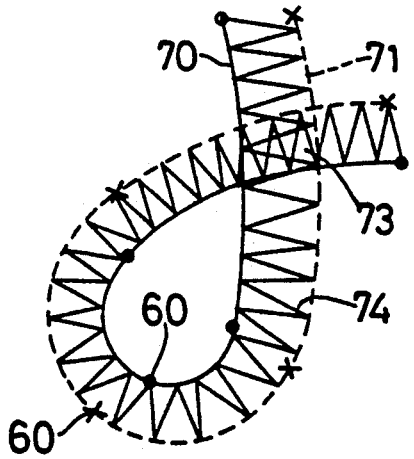
FIG. 15 is a view of an example of an original pattern including a self-crossing portion, and an embroidery formed in the pattern in accordance with the present invention.

FIG. 15 shows an embroidery area defined by first and second curves 70, 71 and including a self-crossing portion 73. It has been impossible to represent such an area by a single polygonal or arcuate block. According to the principle of the present invention, it is easy to produce embroidery data for embroidering the self-crossing embroidery area 70, 71.

In the present embodiment, steps requiring operator's assistance are effected in an earlier phase, and subsequently the remaining steps are automatically carried out in the manner represented by the flow chart of FIG. 9. Therefore, the present data processing apparatus enjoys high production efficiency.

Figure 16:
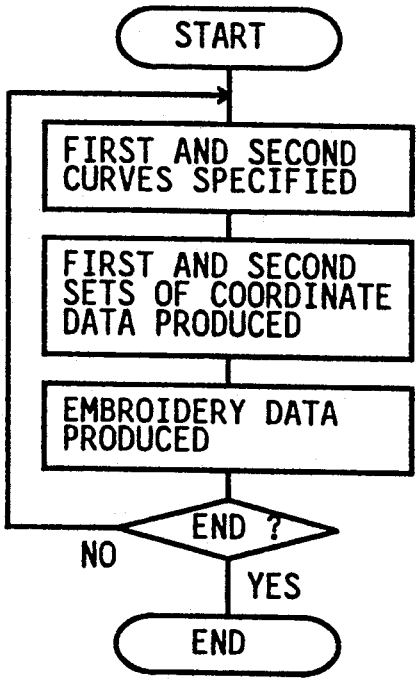
FIG. 16 shows a flow chart, used in a preferred embodiment of the invention, according to which embroidery data is produced based on an original pattern.
Figure 17:
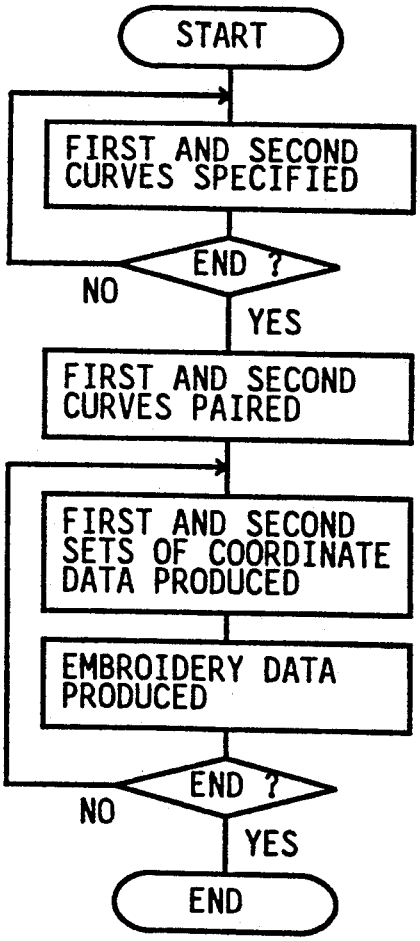
FIG. 17 shows a flow chart, used in another embodiment of the invention, according to which embroidery data is produced based on an original pattern.
Figure 18:
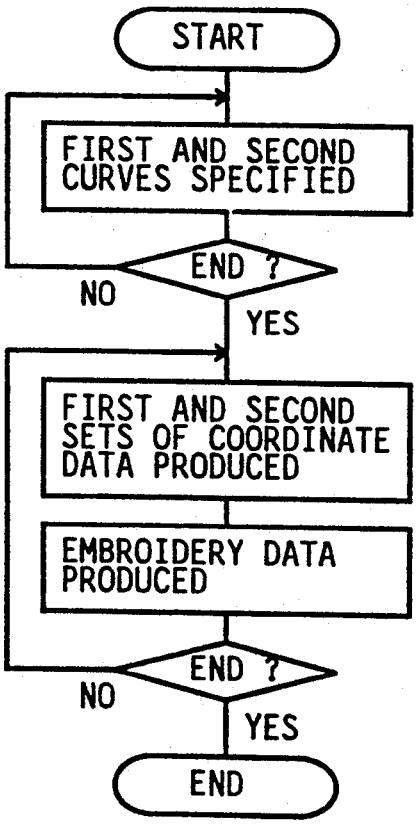
FIG. 18 shows a flow chart, used in yet another embodiment of the invention, according to which embroidery data is produced based on an original pattern.
Figure 19:
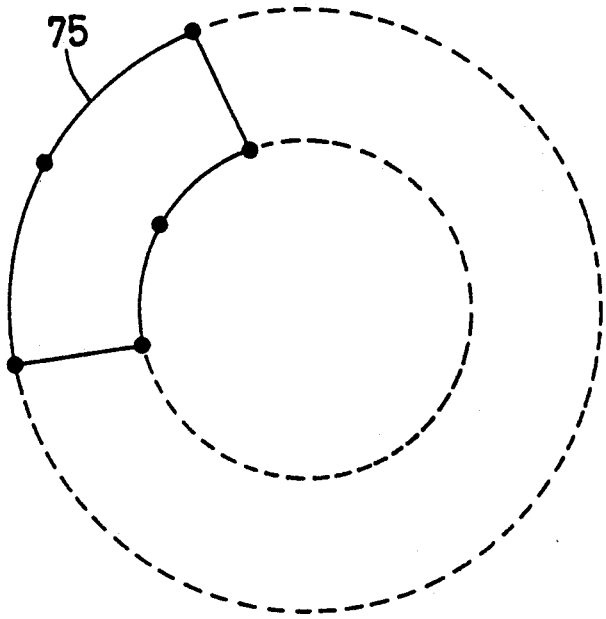
FIG. 19 is a view of an arcuate block which has conventionally been used to approximate a curved outline of an original pattern.

In the present embodiment, a pair of first and second curves are specified with operator's assistance before another pair of first and second curves are specified, and the data processing apparatus automatically establishes an embroidery area based on each pair of first and second curves and produces a batch of embroidery data for forming stitches filling the area, as indicated by the flow chart of FIG. 16. However, it is to be understood that the present invention may be embodied in other manners. For example, it is possible to specify a plurality of curves for approximating an outline of one or more original patterns, and subsequently grouping the curves into one or more pairs of first and second curve to approximate the outline of the one or more original patterns, as indicated by the flow chart of FIG. 17. In this case, the operator is not required to consider the sequence of input of the first and second curves when inputting those curves into the data processing apparatus. In addition, it is possible to specify first defining points defining each of a plurality of first curves and second defining points defining each of a plurality of second curves, in response to operation of the input means 55 by the operator, such that each of the first curves is paired with a corresponding one of the second curves to approximate the outline of a corresponding one of a plurality of original patterns, before batches of embroidery data are produced for the embroidery areas defined by the pairs of first and second curves. In this case, too, steps needing operator's assistance are effected first all together and subsequently the remaining steps are automatically carried out, as indicated by the flow chart of FIG. 18. Therefore, the third embodiment also provides high production efficiency.

It is to be understood that the present invention may be embodied with other changes, arrangements, and modifications that may occur to those skilled in the art without departing from the scope and spirit of the invention defined by the appended claims.

What is claimed is:

1. A process of producing embroidery data for controlling a sewing machine to move a sewing needle and a work cloth relative to each other so as to form stitches filling a desired original pattern on the cloth, the embroidery data including sets of coordinate data each representing a stitch position when the needle penetrates the cloth, the process comprising the steps of:

specifying a plurality of first defining points defining a first curve including at least one first adjustable curve segment in series, and a plurality of second defining points defining a second curve including at least one second adjustable curve segment in series and cooperating with said first curve to approximate an outline of said original pattern;

establishing an embroidery area by connecting between each of both ends of said first curve and a corresponding one of both ends of said second curve, and producing first sets of coordinate data representing a plurality of first stitch positions including at least one position along said first curve, and second sets of coordinate data representing a plurality of second stitch positions including at least one position along said second curve;

producing said embroidery data by using said first and second sets of coordinate data; and controlling said sewing machine in accordance with said embroidery data to form the stitches filling said embroidery area by sequentially connecting with a sewing thread between said first stitch positions and said second stitch positions.

2. The process according to claim 1, wherein the step of specifying said first and second defining points comprises specifying the first defining points defining each of at least one said first curve and the second defining points defining each of at least one said second curve, such that said each first curve is paired with a corresponding one of said at least one second curve before the first and second defining points for another pair of the first and second curves are specified.

3. The process according to claim 1, wherein the step of specifying said first and second defining points comprises specifying the first and second defining points defining a plurality of curves approximating an outline of at least one said original pattern, and subsequently grouping said curves into at least one pair of said first and second curves to approximate the outline of said at least one original pattern.

4. The process according to claim 1, wherein the step of specifying said first and second defining points comprises specifying the first defining points defining each of at least one said first curve and the second defining points defining each of at least one said second curve, in response to operation of input means by an operator, such that said each first curve is paired with a corresponding one of said at least one second curve to approximate the outline of a corresponding one of at least one said original pattern, the step of producing said first and second sets of coordinate data comprising automatically establishing the embroidery area for each of said at least one original pattern and producing the first and second sets of coordinate data for forming stitches filling the embroidery area for said each original pattern, after said at least one first curve is paired with a corresponding one of said at least one second curve, each in response to operation of said input means by said operator.

5. The process according to claim 1, wherein the step of producing said first and second sets of coordinate data comprises producing said first and second sets of coordinate data such that at least one of said first and second stitch positions includes at least one position spaced apart from said first and second curves.

6. An apparatus for producing embroidery data for controlling a sewing machine to move a sewing needle and a work cloth relative to each other so as to form stitches filling a desired original pattern on the cloth, the embroidery data including sets of coordinate data each representing a stitch position where the needle penetrates the cloth, the apparatus comprising:

first means for specifying a plurality of first defining points defining a first curve including at least one first adjustable curve segment in series, and a plurality of second defining points defining a second curve including at least one second adjustable curve segment in series and cooperating with said first curve to approximate an outline of said original pattern;

second means for establishing an embroidery area by connecting between each of both ends of said first curve and a correspondingly one of both ends of said second curve, and for producing first sets of coordinate data representing a plurality of first stitch positions including at least one position along said first curve, and second sets of coordinate data representing a plurality of second stitch positions including at least one position along said second curve;

third means for producing said embroidery data by using said first and second sets of coordinate data; and data processing means for processing said embroidery data to form the stitches filling said embroidery area by sequentially connecting with a sewing thread between said first stitch positions and said second stitch positions.

7. The apparatus according to claim 6, wherein said second means produces said first and second sets of coordinate data such that at least one of said first and second stitch positions includes at least one position spaced apart from said first and second curves.

8. The apparatus according to claim 6, further comprising:

memory means for storing a first set of curve data representing said first curve, and a second set of curve data representing said second curve; and means for inserting separation data between said first sets of curve data and said second sets of curve data when said memory means stores the first and second sets of curve data in sequence, said separation data indicating that the first sets of curve data are different from the second sets of curve data.

9. The apparatus according to claim 8, wherein said second means establishes a plurality of said embroidery areas, said memory means storing sets of area data each representing a corresponding one of said embroidery areas, said each set of area data including said first set of curve data, said separation data, and said second set of curve data, the apparatus further comprising means for adding identification data to said each set of area data when said memory means stores said sets of area data in sequence, said identification data indicating that said each set of area data is different from the other sets of area data.

10. The apparatus according to claim 8, wherein said first means comprises means for specifying a plurality of third defining points defining a third curve including at least one third adjustable curve segment in series, said third curve approximating an original curve along which said sewing needle is to be moved relative to said work cloth, said first memory means storing a third set of curve data representing said third curve without storing any said first separation data associated with said third set of curve data, said second means comprising means for producing at least one third set of coordinate data representing at least one third stitch position along said third curve.

11. The apparatus according to claim 6, wherein said third means comprises first memory means for storing said first and second sets of coordinate data, and means for inserting first separation data between said first sets of coordinate data and said second sets of coordinate data when said first memory means stores the first and second sets of coordinate data in sequence, said first separation data indicating that the first sets of coordinate data are different from the second sets of coordinate data.

12. The apparatus according to claim 11, wherein said second means establishes a plurality of said embroidery areas, said first memory means storing sets of embroidery data each for forming stitches filling a corresponding one of said embroidery areas, each said set of embroidery data including said first sets of coordinate data, said first separation data, and said second sets of coordinate data, said third means further comprising means for adding identification data to said each set of embroidery data when said first memory means stores said sets of embroidery data in sequence, said identification data indicating that said each set of embroidery data is different from the other sets of embroidery data.

13. The apparatus according to claim 11, further comprising:

second memory means for storing a first set of curve data representing said first curve, and a second set of curve data representing said second curve; and means for inserting second separation data between said first sets of curve data and said second sets of curve data when said second memory means stores the first and second sets of curve data in sequence, said second separation data indicating that the first sets of curve data are different from the second sets of curve data, said first means comprising means for specifying a plurality of third defining points defining a third curve including at least one third adjustable curve segment in series, said third curve approximating an original curve along which said sewing needle is to be moved relative to said work cloth, said second memory means storing a third set of curve data representing said third curve without storing any said second separation data associated with said third set of curve data, said second means comprising means for producing at least one third set of coordinate data representing at least one third stitch position along said third curve, said first memory means storing said at least one third set of coordinate data without storing any said identification data associated with the at least one third set of coordinate data, said third means producing said embroidery data by using said at least one third set of coordinate data, so that said sewing machine forms at least one stitch along said third curve with said sewing thread according to the embroidery data so as to move said sewing needle relative to said work cloth.

14. The apparatus according to claim 6, wherein said first means comprises display means for indicating said first and second curves together with said outline of said original pattern, and adjusting means for moving at least one of said first and second defining points on said display means, and thereby adjusting at least one of said first and second adjustable curve segments so that said first and second curves precisely approximate said outline of said original pattern.

15. The apparatus according to claim 6, wherein said first means comprises changing means for changing at least one of said first defining points and at least one of said second defining points so as to adjust at least one said first adjustable curve segment and at least one said second adjustable curve segment, respectively, and thereby precisely approximate the outline of said original pattern.

16. The apparatus according to claim 15, wherein said first means specifies said first defining points such that the first defining points include two first base points which are positioned on the outline of said original pattern and define both ends of a corresponding one of said at least one first adjustable curve segment, respectively, and two first control points different from said two first base points, said two first base points and said two first control points cooperating with each other to define a first Bezier curve as said corresponding one first adjustable curve segment, said first means specifying said second defining points such that the second defining points include two second base points which are positioned on said outline of said original pattern and define both ends of a corresponding one of said at least one second adjustable curve segment, respectively, and two second control points different from said two second base points, said two second base points and said two second control points cooperating with each other to define a second Bezier curve as said corresponding one second adjustable curve segment, said changing means of said first means changing at least one of said two first control points for adjusting said first Bezier curve and at least one of said two second control points for adjusting said second Bezier curve.

17. The apparatus according to claim 6, wherein said data processing means comprises said sewing machine, said sewing machine forming the stitches filling said embroidery area according to said embroidery data.

18. The apparatus according to claim 6, wherein said data processing means comprises a data storage device, which records said embroidery data on a recording medium, said recording medium being removable from the data storage device for transferring said embroidery data to control said sewing machine to form the stitches filling said embroidery area.

19. The apparatus according to claim 18, wherein said recording medium is a floppy disk.

20. A method of producing embroidery data with an embroidery data producing apparatus, and controlling a sewing machine with the embroidery data to move a sewing needle and a work cloth relative to each other so as to form stitches filling a desired original pattern on the cloth, the embroidery data including sets of coordinate data each representing a stitch position where the needle penetrates the cloth, the method comprising the steps of:

specifying a plurality of first defining points defining a first curve including at least one first adjustable curve segment in series, and a plurality of second defining points defining a second curve including at least one second adjustable curve segment in series and cooperating with said first curve to approximate an outline of said original pattern;

establishing an embroidery area by connecting between each of both ends of said first curve and a corresponding one of both ends of said second curve, and producing first sets of coordinate data representing a plurality of first stitch positions including at least one position along said first curve, and second sets of coordinate data representing a plurality of second stitch positions including at least one position along said second curve;

producing said embroidery data in accordance with said first and second sets of coordinate data, in the embroidery data producing apparatus;

recording said embroidery data on a recording medium which is removable from the embroidery data producing apparatus; and controlling said sewing machine with said embroidery data recorded on said recording medium to form the stitches filling said embroidery area by sequentially connecting with a sewing thread between said first stitch positions and said second stitch positions.

* * * * *